US009764994B2

(12) United States Patent
Fiocchi

(10) Patent No.: US 9,764,994 B2
(45) Date of Patent: Sep. 19, 2017

(54) PRIMING MIXTURE

(71) Applicant: Fiocchi Munizioni S.p.A., Lecco (IT)

(72) Inventor: Costantino Fiocchi, Lecco (IT)

(73) Assignee: FIOCCHI MUNIZIONI S.P.A., Lecco (IT)

( * ) Notice: Subject to any disclaimer, the term of this patent is extended or adjusted under 35 U.S.C. 154(b) by 0 days.

(21) Appl. No.: 15/183,508

(22) Filed: Jun. 15, 2016

(65) Prior Publication Data

US 2017/0088481 A1 Mar. 30, 2017

(30) Foreign Application Priority Data

Jun. 19, 2015 (IT) ..... 10201525837

(51) Int. Cl.

| | |
|---|---|
| ***C06B 33/00*** | (2006.01) |
| ***D03D 23/00*** | (2006.01) |
| ***D03D 43/00*** | (2006.01) |
| ***C06B 31/24*** | (2006.01) |
| ***C06B 31/18*** | (2006.01) |

(52) U.S. Cl.

CPC ..... *C06B 31/24* (2013.01); *C06B 31/18* (2013.01)

(58) Field of Classification Search

USPC ..... 149/37, 108.6, 109.2, 109.4

See application file for complete search history.

(56) References Cited

U.S. PATENT DOCUMENTS

2005/0183805 A1* 8/2005 Pile ..... C06C 7/00 149/39

FOREIGN PATENT DOCUMENTS

| | | |
|---|---|---|
| EP | 1230198 A1 | 8/2002 |
| RU | 2283823 C1 | 9/2006 |

OTHER PUBLICATIONS

Kappen, Sascha, "Italian Search Report and Written Opinion for IT 102015000025837," Italian Patent and Trademark Office (UIBM), dated Mar. 7, 2016.

Wise, S. H., et al: "Chemical taggant detection and analysis by laser-induced breakdown spectroscopy", Applied Optics, Optical Society of America, Washington, D.C.; US, vol. 47, No. 31, Jun. 13, 2008, pp. G15-G20.

* cited by examiner

*Primary Examiner* — James McDonough

(74) *Attorney, Agent, or Firm* — Florek & Endres PLLC

(57) ABSTRACT

A priming mixture is described, comprising aluminum silicate in a quantity not exceeding 30% and preferably in a quantity ranging from 15 to 25% by weight, titanium in a quantity ranging from 1 to 10%, preferably from 2 to 7% by weight, samarium oxide in a quantity ranging from 5 to 20%, preferably from 8 to 16% by weight, all quantities referring to the total weight of the priming mixture.

18 Claims, 6 Drawing Sheets

Distribution of gunshot residue (Elsevier Science Ireland Ltd)

Distribution of gunshot residue (Elsevier Science Ireland Ltd)

PRIMING MIXTURE

The present invention relates to a new improved priming mixture for ammunition for small arms.

More specifically, the present invention falls within the field of priming mixtures for ammunition, which must take into account problems associated with a reduction in environmental pollutants and also problems linked to the necessity of investigative requirements of the search for residues after firing. It is in fact becoming increasingly important for the competent authorities that ammunition guarantee the development of highly specific indications as identifying elements that can be easily identified in the solid residues detectable after firing. The two issues are closely related as the analysis of gunshot residues, which is effected using appropriate methods such as spectroscopy on all kinds of samples (fabrics, metal, plastic, leather, etc.) and which allows detection through various analytical methods such as, for example, X-ray analysis, scanning electron microscope analysis, etc. was effected in the past by specifically identifying traces of combinations of lead, antimony and other heavy metals. These elements, in fact, by giving rise to easily detectable characteristic signals through the above analytical methods, and as they were not elements present in the environment as a combination, allowed gunshot residues to be identified after the use of a firearm. The necessity of eliminating lead, antimony and other heavy metals for reasons of pollution and, at the same time, progress in research in the field of ballistics, that led to the belief that some of these elements or products formed from these after firing cannot in reality be univocally attributed to gunshot residues, created the necessity of finding new tracing substances.

These demands therefore led and continue to lead to an evolution in priming mixtures.

As is well-known, a percussion primer is present in ammunition, that contains the so-called priming mixture that ignites the launching charge of the bullet and the composition of the priming mixture is extremely important for obtaining a primer having the desired characteristics of stability, safety and sensitivity for its specific function.

Requirements of an environmental nature and also relating to the traceability of gunshot residues, after firing, have therefore led to the development of new compositions for priming mixtures that, in any case, must first of all guarantee the primary objective of the same priming mixture specified above.

Starting therefore from priming mixtures containing heavy metals and their compounds which, due to their high toxicity, are becoming less and less acceptable and accepted, the priming mixtures according to the state of the art first replaced compounds of barium, antimony and lead with zinc peroxide, copper oxide, manganese dioxide or tin oxide.

These alternative formulations, however, did not prove to be lacking in drawbacks which make them in any case unsatisfactory for solving the technical problem previously specified: there remains the presence of a residual toxicity, the production costs are high, the characteristics of the formulations are not stable with a variation in the temperature and/or have a reduced ballistic efficiency, finally the traces in the gunshot residues cannot be univocally attributed to it.

Zinc peroxide, for example, is costly and difficult to obtain in the pure state, also have a reduced sensitivity to low temperatures.

By way of example, EP1230198 describes priming compositions which, in addition to diazodinitrophenol and tetrazene, contain zinc peroxide in special forms. This allows the zinc to be emitted as "harmless" zinc oxide. The priming composition according to EP1230198 also envisages a tracing substance selected from zirconium or elements belonging to rare earth.

As explained above, however, these compositions are characterized by a limited sensitivity to low temperatures in addition to a residual toxicity, specifically associated with the presence of zinc. Another negative element of the priming mixtures according to EP1230198 is linked to the fact that the choice of elements belonging to rare earth comprises, for example, elements such as cerium that cannot be univocally attributed to gunshot residues, but can, on the contrary, derive from the use of lighters: these are therefore elements that can in no way lead to the conclusion that their presence on the samples analyzed can be exclusively attributed to gunshot.

The general objective of the present invention is therefore to overcome the drawbacks indicated above, by providing a priming mixture that has high ballistic characteristics of stability, safety and sensitivity, that does not contain heavy metals or other compounds unacceptable for their toxicity and, at the same time, that has gunshot residues that can be simply and reliably identified scientifically, without the risk of this identification being the result of an environmental contamination, and therefore highly specific.

An object of the present invention therefore relates to a priming mixture characterized in that it comprises aluminium silicate in a quantity not exceeding 30% and preferably in a quantity ranging from 15 to 25% by weight, titanium in a quantity ranging from 1 to 10%, preferably from 2 to 7% by weight, samarium oxide in a quantity ranging from 5 to 20%, preferably from 8 to 16% by weight, all quantities referring to the total weight of the priming mixture.

The priming mixture according to the present invention therefore comprises a sensitizing agent not belonging to the category of heavy metals, and specifically aluminium silicate and a tracing substance for the detection and scientific identification of gunshot residues, which is reliable, simple and without the risk of this identification being the result of an environmental contamination, which is samarium or a compound thereof, in a mixture with titanium, in a finely divided metal form.

More specifically, the priming mixture according to the present invention also comprises a potassium compound in a quantity of over 10% by weight. The preferred potassium compound is potassium nitrate in a quantity of over 25% and, more preferably, over 30% by weight with respect to the total weight of the priming mixture. A quantity of potassium nitrate ranging from 30 to 40% by weight is particularly advantageous for the quality of the priming mixture.

The main explosive of the priming mixture according to the present invention is preferably diazodinitrophenol in a quantity ranging from 22 to 32% by weight, preferably from 25 to 30% by weight, even more preferably equal to 27% by weight, and the secondary explosive is preferably tetrazene in a quantity ranging from 2 to 7% by weight, preferably equal to 4% by weight, with respect to the total weight of the priming mixture.

Furthermore, the priming mixture according to the present invention can also preferably comprise a binder such as nitrocellulose in a quantity ranging from 2 to 5% by weight, preferably from 3 to 4% by weight, and an agent such as penthrite, in a quantity ranging from 2 to 7% by weight, preferably from 3 to 4% by weight, with respect to the total weight of the priming mixture.

The preferred priming mixture according to the present invention is a priming mixture consisting of diazodinitrophenol in a quantity ranging from 22 to 32% by weight;

tetrazene in a quantity ranging from 3 to 5% by weight;

potassium nitrate in a quantity ranging from 25 to 35% by weight;

nitrocellulose in a quantity ranging from 2 to 4% by weight;

aluminium silicate in a quantity ranging from 16 to 24% by weight;

penthrite in a quantity ranging from 2 to 4% by weight;

titanium metal in a quantity ranging from 3 to 7% by weight;

samarium oxide in a quantity ranging from 8 to 13% by weight, all quantities referring to the total weight of the priming mixture.

A further object of the present invention also relates to the use of the priming mixture according to the present invention as a generating element of gunshot residues exclusively identifiable through scanning electron microscope analysis with an energy dispersion microprobe.

The priming mixture according to the present combination has the advantage of also comprising a sensitizing agent consisting of aluminium silicate which produces a sensitivity analogous to that of antimony sulfide, optimum for its technical features but no longer acceptable for its toxicity. Furthermore the characteristics of sensitivity, safety and stability of the priming composition remain stable with a variation in the temperature, also solving the problem of instability at low temperatures, specific of priming compositions containing derivatives of zinc. In particular, the combination of aluminium silicate as sensitizing agent, with titanium and samarium oxide, allows a priming mixture to be obtained with a sensitivity which is at least comparable to and often higher than that of traditional mixtures, which is also stable, efficient and functional at low temperatures and which solves the problem of identifying gunshot residues in a reliable and simple way and without the risk of this identification being the result of an environmental contamination.

The residues deriving from this priming mixture can allow the lot of ammunition to be identified, consequently attributing the ammunition to a certain supplier, and also identifying the shooter of the firearm.

The gunshot residues deriving from ammunition that uses the priming mixture according to the present invention contain non-volatile traces that provide a highly specific indication of these residues. More specifically, the priming mixture according to the present invention is particularly interesting as the elements contained in the gunshot residues provide reliable and accurate answers relating to two different spheres of problems that are encountered in criminological investigations.

Figure 1:
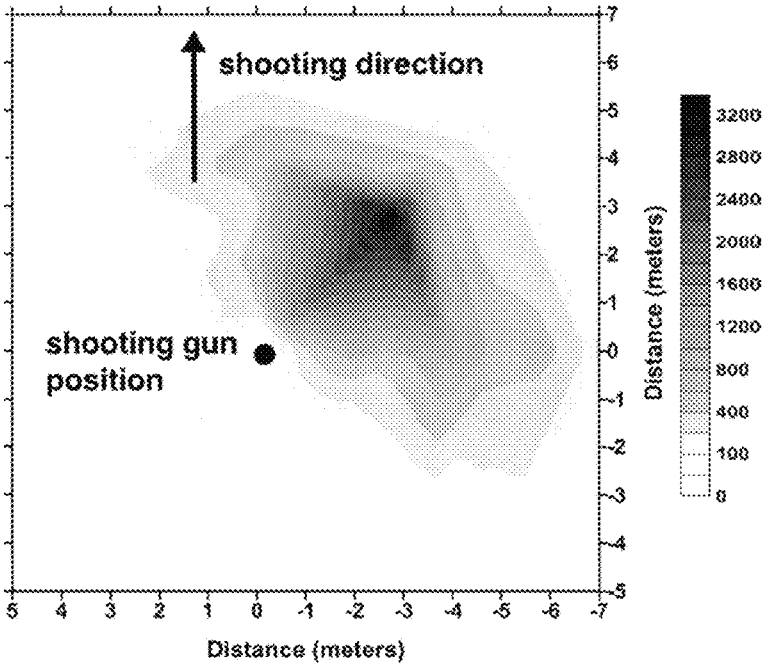
FIG. 1 is an exemplary distribution of Gun Shot Residue particles generated from a 9 mm gun using a priming mixture according to an embodiment of the present invention.

The particles emitted from a firearm at the moment of firing, generally indicated with the acronym GSR (Gun Shot Residues), comprise tens of compounds deriving from the primers, powders and metal of the bullet. Instead of the term "gunshot residues", the above abbreviation "GSR" is therefore often used. Forensic science has extensively studied the composition, morphology and distribution of these particles, as identifying them is of indispensable help in criminal investigations. The distribution of GSR particles of a 9 mm gun, for example, object of the analyses described in the following examples, in all the tests effected, showed that the main ejection direction of the particles is that at 45° towards the right of the firing direction, with the maximum concentration at a distance of about 3 m from the shooter, as illustrated in FIG. 1. The shot generates particles having relatively variable dimensions and the particles deriving from the priming mixture have dimensions smaller than about ten μm. The particles of unburned powder from gunshot can, on the other hand, have much larger dimensions, up to about 500 μm. Some particles are also detected at a distance of over 10 m from the shooter, most of them however are within 7 m.

A first type of verification that is carried out on the samples collected as part of these investigations, is based on the search for and analysis of the particles forming gunshot residues through the SEM/EDX technique, which envisages the use of a scanning electron microscope (SEM) for observation technique, coupled with an energy dispersion microprobe (EDX), that enables the elemental analysis of the sample, making use of the principle according to which an accelerated beam of incident electrons on a sample causes the emission of the innermost electrons of the atoms of the same sample; the subsequent return to the basic configuration induces the emission, inter alia, of X-rays with a predefined energy, specific for each element and in a number proportional to the concentration of the element which is being analyzed at that moment. With this type of analysis, it is possible to identify the lot of ammunition, consequently attributing the ammunition to a certain supplier, and also identifying the shooter of the firearm.

A second type of verification which is again effected on gunshot residues, through staining methods (Chemigraphy), allows copper particles present in the gun powder (and not in the priming mixture) to be revealed, in order to identify the shooting distance and provide a better reconstruction of the dynamics with which the events took place.

More specifically, the SEM/EDX tests carried out in the examples provided below, were effected applying the following protocol:

SEM/EDX Test

Figure 2:
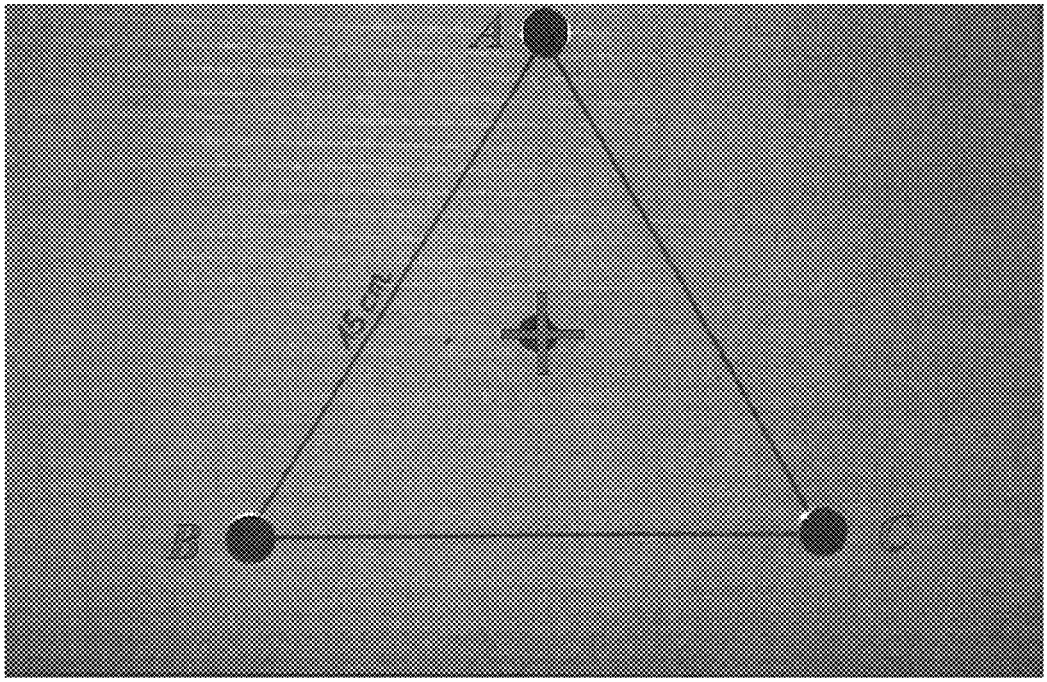
FIG. 2 is an exemplary layout of test diskettes for conducting analysis of Gun Shot Residue generated from priming mixtures of the present invention.

Three test diskettes (diameter 12.7 mm) were fixed to a support (for example cardboard) so that their seats form the angles of an equilateral triangle with a side of 15 cm, as represented in FIG. 2.

The test diskette (SEM) has an adhesive layer facing the firearm.

This arrangement is subsequently hit with the ammunition to be tested, using a carefully cleaned firearm to exclude any contamination due to previous firing tests. A distance of about 50 cm must be kept between the support and the mouth of the barrel. The extension of the axis of the barrel must be perpendicular to the barycentre of the triangle formed by the three diskettes, that must be oriented with the adhesive sheet towards the mouth of the barrel.

By tapping on the cartridge case of one of the cartridges fired, reference gunshot residues become attached to the diskette (reference smoke test sample).

The analysis of the diskettes hit was effected by means of a scanning electron microscope with an energy dispersion microprobe, automatically, comparing with the above reference test sample.

EXAMPLES

Some embodiment examples of priming mixtures according to the present invention and comparative priming mixtures are provided hereunder for illustrative but non-limiting purposes of the present invention.

Example 1

A priming mixture according to the present invention was formulated, having the following composition (weight percentage):

Diazodinitrophenol 27%
Penthrite 2%
Tetrazene 4%
Aluminium silicate 21%
Potassium nitrate 30%
Titanium 5%
Samarium oxide 9%
Nitrocellulose 2%

Said priming mixture applied to ammunition for a calibre 9 firearm was tested to verify its properties in terms of heavy metal residues, stability and ballistic effectiveness at different temperatures, and also in terms of traceability of the gunshot residues.

Heavy metal residues: upon analysis with analysis techniques, such as for example Plasma ICP, the ammunition with the priming mixture according to Example 1 had heavy metal residues lower than 0.01%.

Stability at different Ts: by applying the EPVAT NATO method, it was observed that the ammunition with the priming mixture according to Example 1 is stable and ballistically effective at any temperature from −54° C. to +52° C.

Figure 3:
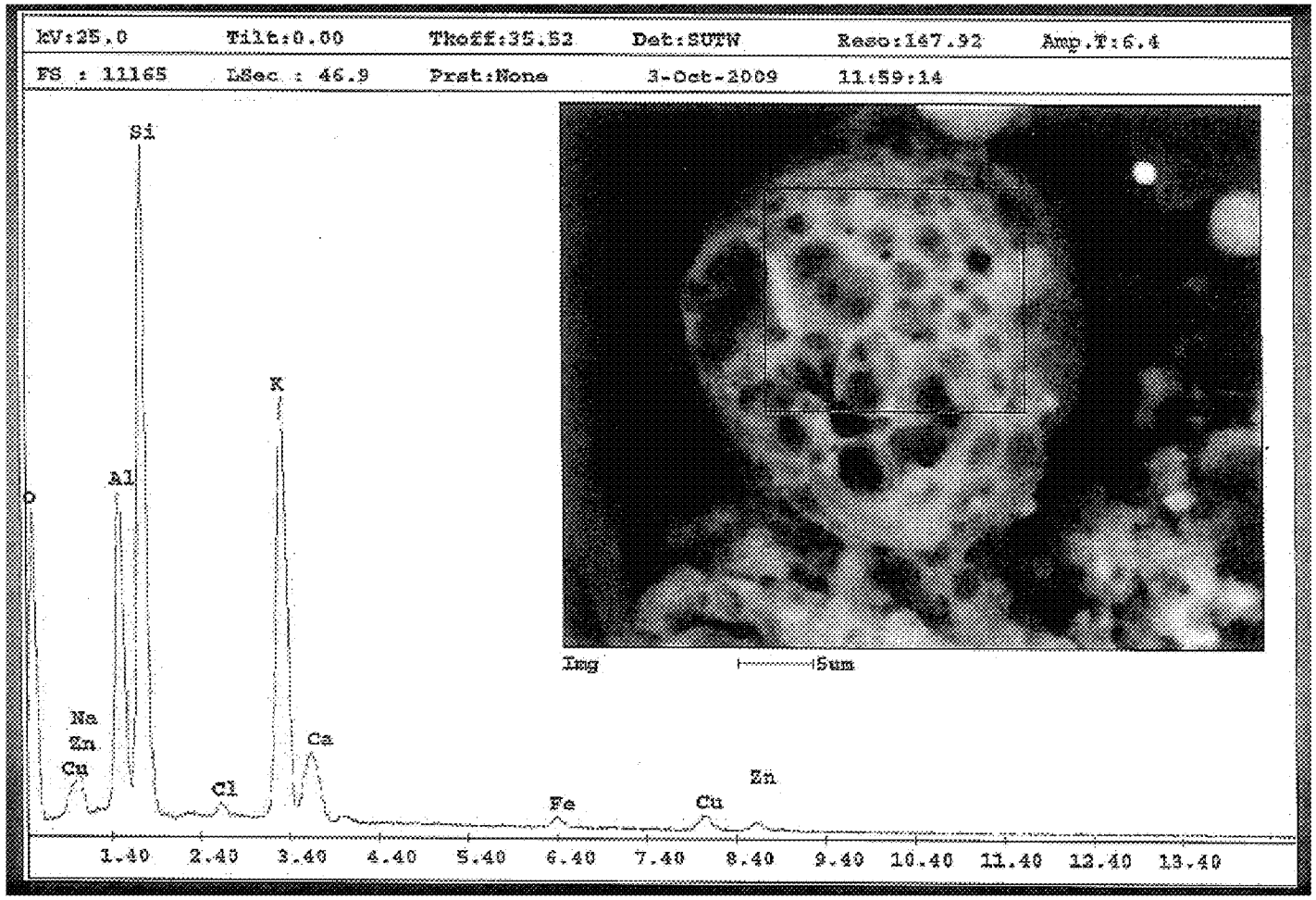
FIG. 3 is an exemplary SEM/EDX analysis of Gun Shot Residue resulting from a control priming mixture according to an embodiment of the present invention for use as a reference spectrum.
Figure 4:
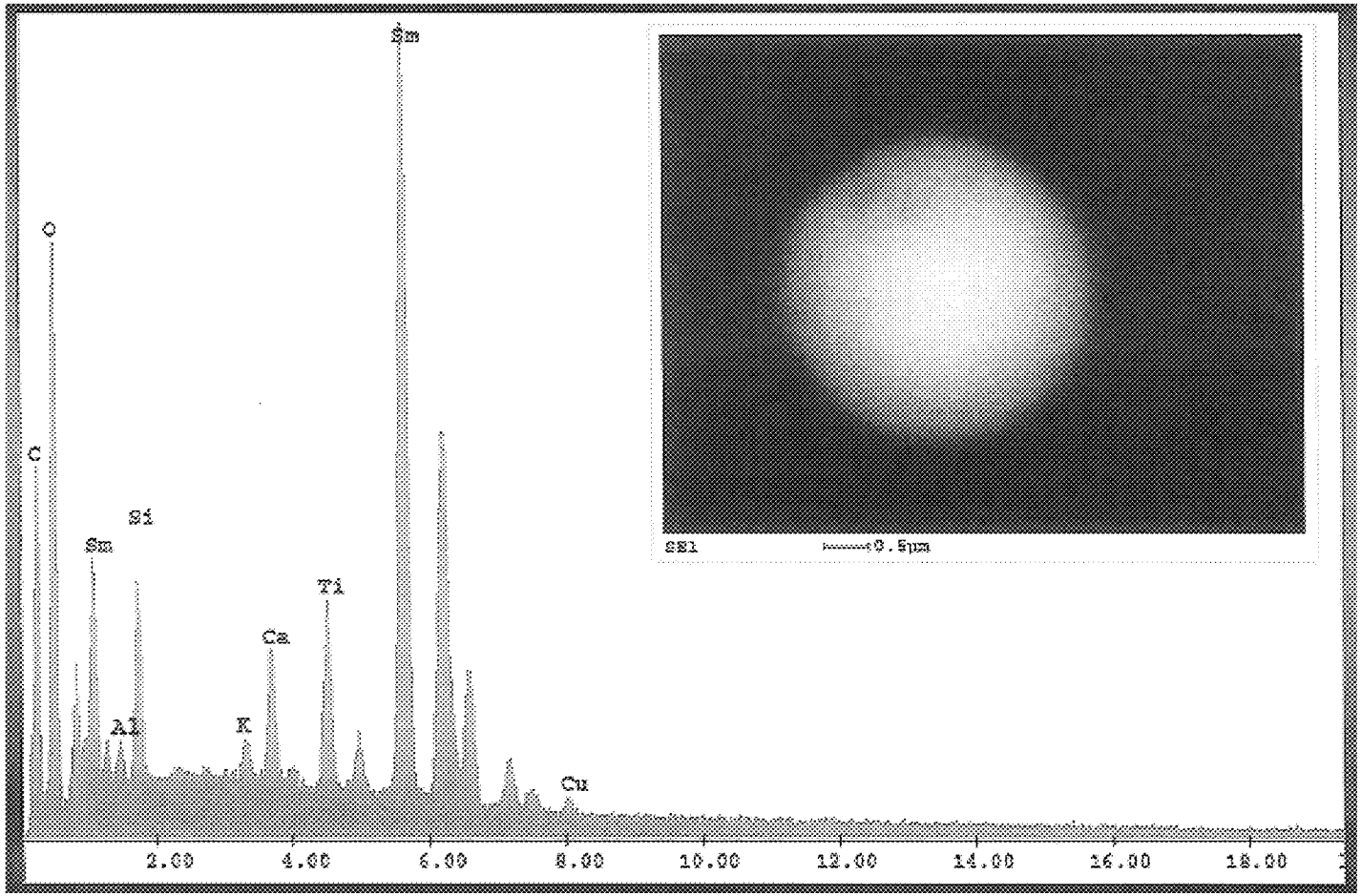
FIG. 4 is an exemplary SEM/EDX analysis of Gun Shot Residue resulting from a priming mixture according to an embodiment of the present invention described in Example 1.

FIGS. 3 and 4 enclosed with the present patent application show the SEM/EDX analysis of the gunshot residues of the priming mixture without titanium and samarium oxide as reference spectrum (FIG. 3) and the gunshot residues of the priming mixture according to Example 1 (FIG. 4).

The samarium signal is in a position which is particularly easy to detect, as it is far from the signals of all the other elements present in the priming mixture. More specifically, the energy of one of the three lines having the greatest intensity of samarium from −1 keV to 15 keV at the Röntgen fluorescence spectrum, is significant and is clearly distinguished from that of the other elements present.

Example 2

A priming mixture according to the present invention was formulated, having the following composition (weight percentage):

Diazodinitrophenol 25%
Penthrite 3%
Tetrazene 5%
Aluminium silicate 20%
Potassium nitrate 31%
Titanium 5%
Samarium oxide 11%

This priming mixture, also applied to ammunition for a calibre 9 firearm, was tested to verify its properties in terms of heavy metal residues, stability and ballistic effectiveness at different temperatures, and also in terms of traceability of the gunshot residues.

Heavy metal residues: upon analysis with analysis techniques, such as for example Plasma ICP, the ammunition with the priming mixture according to Example 2 had heavy metal residues lower than 0.01%.

Stability at different Ts: by applying the EPVAT NATO method, it was observed that the ammunition with the priming mixture according to Example 2 is stable and ballistically effective at any temperature from −54° C. to +52° C.

Also in this case, the samarium can be clearly identified, even when present in lower quantities with respect to those present in Example 1.

Example 3 (Comparative)

A priming mixture was formulated, having the following composition (weight percentage):

Diazodinitrophenol 25%
Penthrite 3%
Tetrazene 5%
Aluminium silicate 20%
Potassium nitrate 31%
Titanium 5%
Cerium oxide 5%
Lanthanum oxide 4%
Nitrocellulose 2%

This priming mixture, also applied to ammunition for a calibre 9 firearm, was tested to verify its properties in terms of unequivocal analysis of the gunshot residues.

Figure 5:
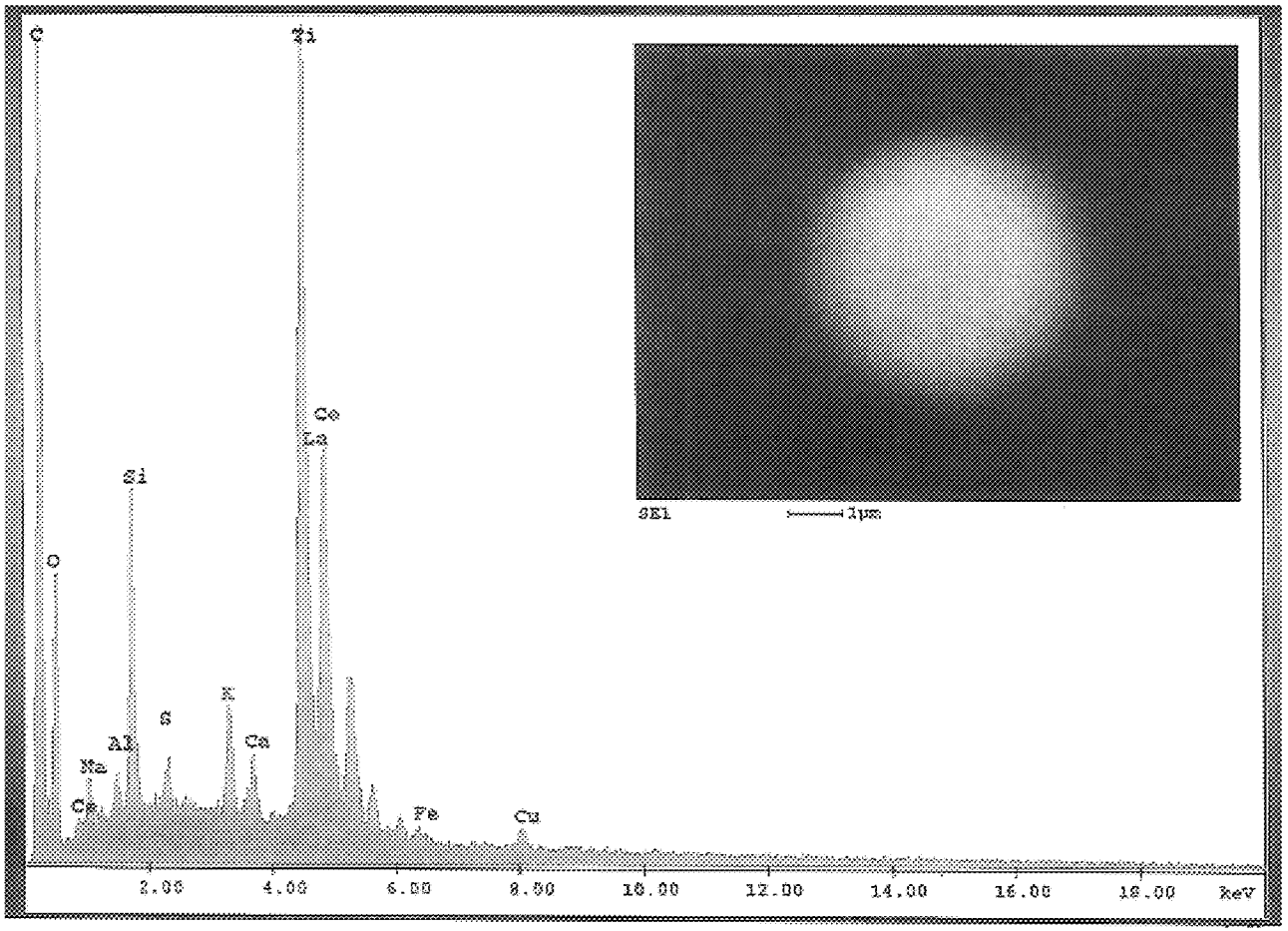
FIG. 5 is an exemplary REM/EDX analysis of Gun Shot Residue resulting from a priming mixture according to an embodiment of the present invention described in Example 3.
Figure 6:
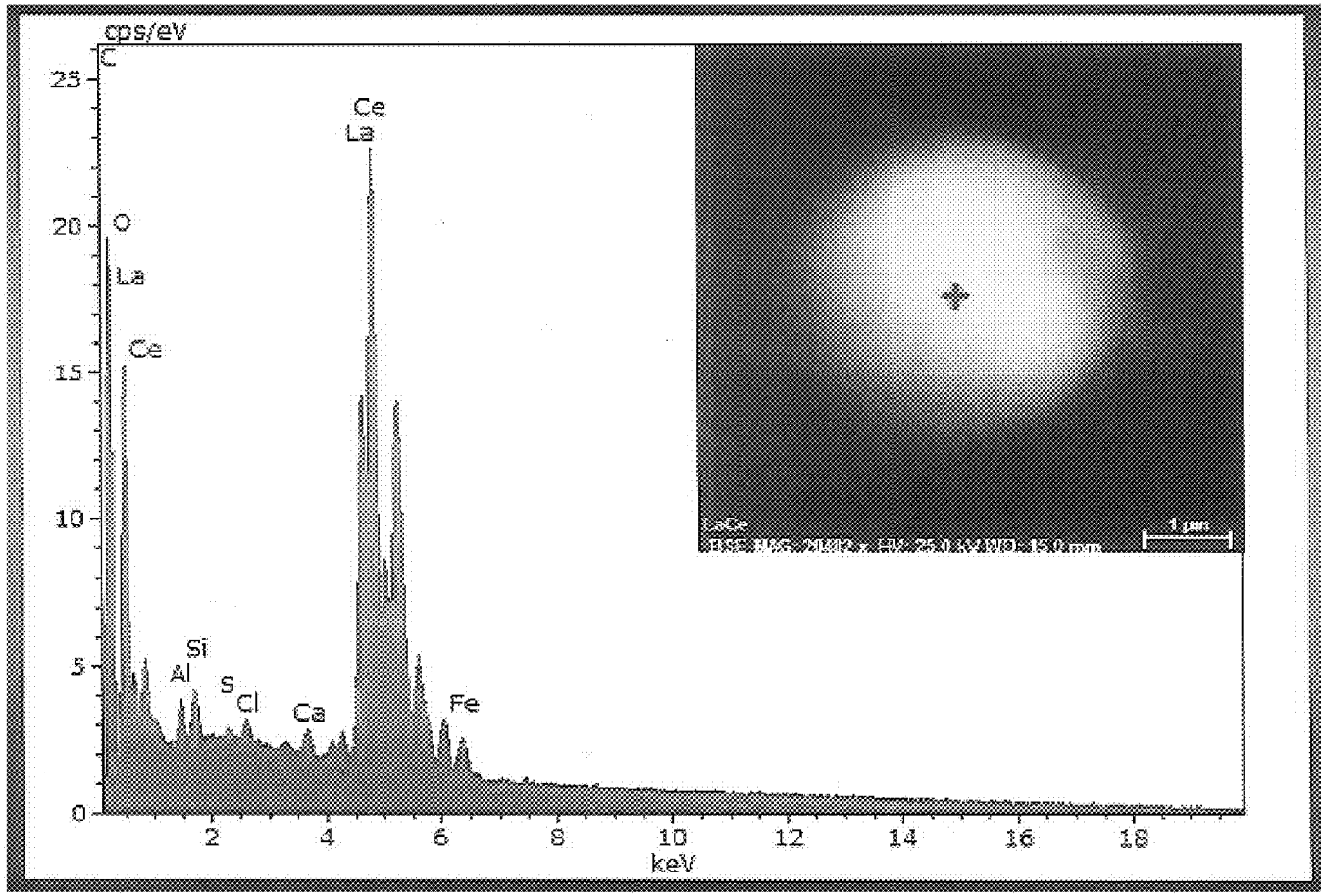
FIG. 6 is an exemplary REM/EDX analysis of a paraffin glove control.

FIG. 5 enclosed with the present patent application shows the REM/EDX analysis of the gunshot residues of the priming mixture according to comparative Example 3, whereas FIG. 6 shows the REM/EDX analysis of a sample obtained from the paraffin glove test of a person who had not fired. The possible metals resulting in the spectrum of FIG. 6 are consequently not due to gunshot residues, but to environmental pollution due to the working environment (for example bodywork operator, mechanic) or quite simply to the use of objects that can cause a contamination of the user with said metals (for example the use of cigarette lighters). FIG. 6 indicates that lanthanum and cerium can be present in the environment and this makes the measurement based on the identification of these metals unreliable and not univocal: by comparing FIG. 5 with FIG. 6, it is evident that the presence of traces of said metals in FIG. 5 cannot be associated with certainty with the presence of cerium/lanthanum in the priming mixture and not attributable, on the other hand, to the cerium/lanthanum already present in the environment (as indicated in FIG. 6).

The invention claimed is:

1. A priming mixture characterized in that it comprises aluminium silicate in a quantity not exceeding 30% by weight, titanium in a quantity ranging from 1 to 10% by weight, samarium oxide in a quantity ranging from 5 to 20% by weight, all quantities referring to the total weight of the priming mixture.

2. The priming mixture according to claim 1, wherein the titanium is in a finely divided metal form.

3. The priming mixture according to claim 1, wherein the mixture also comprises a potassium compound in a quantity of over 10% by weight, with respect to the total weight of the priming mixture.

4. The priming mixture according to claim 1, wherein the mixture also comprises diazodinitrophenol in a quantity ranging from 22 to 32% by weight, and tetrazene in a quantity ranging from 2 to 7% by weight, with respect to the total weight of the priming mixture.

5. The priming mixture according to claim 1, wherein the mixture also comprises nitrocellulose in a quantity ranging from 2 to 5% by weight, and/or penthrite in a quantity ranging from 2 to 7% by weight with respect to the total weight of the priming mixture.

6. The priming mixture according to claim 1, wherein the priming mixture consists of:

diazodinitrophenol in a quantity ranging from 22 to 32% by weight;

tetrazene in a quantity ranging from 3 to 5% by weight;

potassium nitrate in a quantity ranging from 25 to 35% by weight;

nitrocellulose in a quantity ranging from 2 to 4% by weight;

aluminium silicate in a quantity ranging from 16 to 24% by weight;

penthrite in a quantity ranging from 2 to 4% by weight;

titanium metal in a quantity ranging from 3 to 7% by weight;

samarium oxide in a quantity ranging from 8 to 13% by weight, all quantities referring to the total weight of the priming mixture.

7. The priming mixture according to claim 1, wherein the priming mixture is selected from the following mixtures:

a) diazodinitrophenol 27%; penthrite 2%; tetrazene 4%; aluminium silicate 21%; potassium nitrate 30%; titanium 5%; samarium oxide 9%; nitrocellulose 2%, all quantities being by weight and referring to the total weight of the priming mixture, and b) diazodinitrophenol 25%; penthrite 3%; tetrazene 5%; aluminium silicate 20%; potassium nitrate 31%; titanium 5%; samarium oxide 11%, all quantities being by weight and referring to the total weight of the priming mixture.

8. The priming mixture according to claim 1, wherein the aluminium silicate is in a quantity ranging from 15 to 25% by weight.

9. The priming mixture according to claim 1, wherein the titanium is in a quantity ranging from 2 to 7% by weight.

10. The priming mixture according to claim 1, wherein the samarium oxide is in a quantity ranging from 8 to 16% by weight.

11. The priming mixture according to claim 3, wherein the potassium compound is in a quantity ranging from 30 to 40% by weight.

12. The priming mixture according to claim 3, wherein the potassium compound is potassium nitrate in a quantity over 25% by weight.

13. The priming mixture according to claim 12, wherein the potassium nitrate is in a quantity over 30% by weight.

14. The priming mixture according to claim 4, wherein the diazodinitrophenol is in a quantity ranging from 25 to 30% by weight.

15. The priming mixture according to claim 4, wherein the diazodinitrophenol is in a quantity equal to 27% by weight.

16. The priming mixture according to claim 4, wherein the tetrazene is in a quantity equal to 4% by weight.

17. The priming mixture according to claim 5, wherein the nitrocellulose is in a quantity ranging from 3 to 4% by weight.

18. The priming mixture according to claim 5, wherein the penthrite is in a quantity ranging from 3 to 4% by weight.

* * * * *